US006523381B1

(12) United States Patent
Ritz et al.

(10) Patent No.: US 6,523,381 B1
(45) Date of Patent: Feb. 25, 2003

(54) LOCK WITH A CENTER GAP SIDEBAR

(75) Inventors: Alan J. Ritz, Brookfield, WI (US); Kenneth R. Hall, Manitowoc, WI (US)

(73) Assignee: Strattec Security Corporation, Milwaukee, WI (US)

( * ) Notice: Subject to any disclaimer, the term of this patent is extended or adjusted under 35 U.S.C. 154(b) by 0 days.

(21) Appl. No.: 09/539,758

(22) Filed: Mar. 31, 2000

(51) Int. Cl.[7] ..... E05B 29/04
(52) U.S. Cl. ..... 70/495; 70/492
(58) Field of Search ..... 70/495, 496, 492, 70/493, 494

(56) References Cited

U.S. PATENT DOCUMENTS

| | | | | | |
|---|---|---|---|---|---|
| 2,003,086 | A | | 5/1935 | Liss | 70/47 |
| 2,024,441 | A | * | 12/1935 | FitzGerald | 70/495 |
| 2,036,747 | A | * | 4/1936 | FitzGerald | 70/496 |
| 2,405,911 | A | * | 8/1946 | Swanson | 70/495 |
| 2,660,876 | A | * | 12/1953 | Spain | 70/495 |
| 3,002,268 | A | * | 10/1961 | Spain | 70/495 X |
| 3,080,744 | A | * | 3/1963 | Spain | 70/495 |
| 3,287,944 | A | * | 11/1966 | Crumb | 70/495 |
| 3,410,123 | A | * | 11/1968 | Jacobi | 70/495 |
| 3,455,130 | A | * | 7/1969 | Basseches | 70/495 X |
| 4,561,270 | A | * | 12/1985 | Spreng | 70/495 |
| 5,001,914 | A | * | 3/1991 | Edwards | 70/495 |
| 5,454,246 | A | | 10/1995 | Mueller | 70/495 |
| 5,540,071 | A | | 7/1996 | Reikher | 70/495 |
| 5,611,225 | A | * | 3/1997 | Resch et al. | 70/495 X |

FOREIGN PATENT DOCUMENTS

| | | | | |
|---|---|---|---|---|
| GB | 657385 | * | 9/1951 | 70/495 |

* cited by examiner

*Primary Examiner*—Lloyd A. Gall
(74) *Attorney, Agent, or Firm*—Michael Best & Friedrich LLP

(57) ABSTRACT

A sidebar for use for automotive locks and all sidebar locks includes an interruption in an edge along the surface to interrupt the inclined plane that is formed when the sidebar becomes canted relative to the longitudinal axis of the lock barrel as the result of the insertion of an incorrectly coded key, in particular a cousin key, into the lock barrel. In one embodiment, the interruption is provided by a gap at or near the longitudinal midpoint of the sidebar. The gap is of sufficient size to accommodate the sidebar biasing spring. In another embodiment, the interruption is provided by indenting the sides of the sidebar at the longitudinal midpoint of the sidebar. In a further embodiment, the sidebar groove in the sleeve is widened at a location corresponding to the longitudinal midpoint of the sidebar.

16 Claims, 9 Drawing Sheets

LOCK WITH A CENTER GAP SIDEBAR

BACKGROUND OF THE INVENTION

FIELD OF THE INVENTION

The present invention relates generally to sidebar locks, and more particularly, to a sidebar lock including a sidebar which includes a longitudinal interruption at or near the longitudinal midpoint of the sidebar which interrupts any inclined plane formed by the sidebar being canted when a key coded different from the correct code is inserted into the lock barrel.

Traditional sidebar locks include a lock barrel, a stationary sleeve extending around the lock barrel, and a spring biased sidebar on the lock barrel which projects into a slot in the sleeve to prevent rotation of the lock barrel unless a mating key is present in the lock barrel. The lock barrel is coupled to an output mechanism which, by way of example, can be a vehicle ignition switch, a latch for a vehicle door, deck, hatch, lift gate or tail gate, the bail on a padlock, levers on panel locks, residential and commercial door latches, etc. For example, the lock barrel can have a lever or drive shaft attached thereto. The lever can be linked to the latch by a rod or cable arrangement. The drive shaft can be coupled with a latch or with a cable drive to the latch.

One such sidebar lock is illustrated in FIGS. 28 and 29, which are labeled "Prior Art". The sidebar lock is mechanically unlocked by a mating or "correct" key (not shown) inserted into the lock barrel 122 for aligning a plurality of tumblers 124 to withdraw a sidebar 126 from a sidebar groove 129 in a sleeve 130. The sidebar 126 prevents rotation of the lock barrel in the absence of the "correct" key in the lock barrel. The sidebar lock illustrated in FIGS. 28 and 29 has a key 120 with nearly the same code as the "correct" key, commonly called a cousin key, inserted into the lock barrel. As will be described, for such condition, the sidebar 126 can be retracted partially from the sidebar groove 129 in the sleeve at an inclined angle to the axis of the lock barrel as shown in FIG. 28.

The tumblers 124 include notches 127 which are normally out of alignment with an edge 128 of the sidebar so that the tumblers 124 force the sidebar radially outward, against the force of sidebar bias springs 131 and 132 into the sidebar groove 129 in sleeve 130. In such position, the sides 133 and 134 of the sidebar 126 cooperate with the sides of the sleeve groove to prevent the lock barrel from rotating relative to the sleeve. The "correct" key aligns tumblers 124 in the lock barrel 122, allowing the edge 128 of the sidebar 126 to be received in the notches 127, permitting the sidebar to be retracted into the lock barrel. With the sidebar retracted, the lock barrel can be rotated within the sleeve 130 to actuate the output mechanism.

Depending upon the number and location of the tumblers 124 supporting the sidebar 126, the sidebar can be retracted partially from the sidebar groove 129 in the sleeve at an inclined angle to the axis of the lock barrel as shown in FIG. 28. This is particularly true when a key, such as a cousin key 120, with nearly the same code as the "correct" key, is used. For such condition, the surface of edge 138 of the sidebar forms an inclined plane which bridges the shear line 140 between the lock barrel and the sleeve. The inclined plane formed by edge 138 allows relative sliding movement between the sidebar and the sleeve, causing the sidebar to be driven into the lock barrel if the lock barrel is forcibly rotated. To reduce this occurrence, lock manufacturers generally limit the number of usable key codes so that very similar keys are not produced.

The prior art sidebar lock, shown in FIG. 28, includes a conventional sidebar, such as the sidebar 126 shown in FIGS. 30–33. The sidebar is biased into the barrel lock by bias springs 131 and 132 which are supported on mounting surfaces 141 and 142 of the sidebar defined by reduced height portions located at opposite ends of the sidebar. The springs 131 and 132 can be held in place by spring clips 136. The edge 138 of the sidebar 126 can be forced out of the sidebar groove when the lock barrel is forcibly rotated when a cousin key is present in the keyslot, with the inclined edge 138 of the sidebar sliding along the surface of the sleeve 130, whereby the sidebar is forced into the lock barrel.

Because of the reduced height end portions of the prior art sidebar 126, the engagement of the sidebar 126 with the groove 129 in the sleeve 130 is limited by this design. This significantly decreases the effort required to forcibly rotate the lock barrel when a cousin key is present in the key slot, with the inclined edge 138 of the sidebar sliding along the surface of the sleeve 130, thereby forcibly driving the sidebar into the lock barrel.

Forcibly driving the sidebar into the lock barrel can cause the sidebar to be plastically deformed at edge 128 of the sidebar 126 at the point of engagement with the tumblers and/or compress the tumbler springs 143, thus defeating the locking function.

When a key having a code that is very similar to the correct code is used, the rotational force required to defeat the locking function is a small fraction of the rotational force the lock can normally withstand. Accordingly, manufacturers are limited in the number of key codes they can offer. The present invention significantly increases the number of robust key codes. The greater the number of robust codes available, the greater the security of the lock.

SUMMARY OF THE INVENTION

The disadvantages and limitations of the background art discussed above are overcome by the present invention. With this invention, there is provided a new and improved sidebar lock which comprises a sleeve including a sidebar groove extending longitudinally along a surface of the sleeve and a lock barrel supported within the sleeve for rotation relative to the sleeve. The lock barrel is adapted for connection to an output mechanism. The sidebar lock includes a sidebar which is movable radially relative to the lock barrel between an extended position in which an edge of the sidebar extends into the sidebar groove and cooperates with the sidebar groove to prevent relative rotation between the lock barrel and the sleeve, and a retracted position in which the sidebar is retracted into the lock barrel, permitting relative rotation between the lock barrel and the sleeve. In accordance with the invention, either the edge of the sidebar or a surface of the sleeve adjacent to the sidebar include an interruption. In one embodiment, the interruption is a gap in an edge surface of the sidebar. In another embodiment, the interruption is an indentation in an edge surface of the sidebar. In a further embodiment, the interruption is provided by widening the sidebar groove in the sleeve.

The surface interruption negates the effect of an inclined plane, formed as the result of the sidebar being partially withdrawn from a sidebar groove in the sleeve such that the sidebar extends at an angle relative to the axis of the lock barrel. Without such surface interruption, a key having a coding similar to the coding for the mated key for the lock, can cause the sidebar to be slid along the surface of the sleeve and be driven out of the sidebar groove.

The present invention significantly increases the number of robust key codes. The greater the number of robust key codes that are available, the greater the security of the sidebar lock.

DESCRIPTION OF THE DRAWINGS

These and other advantages of the present invention are best understood with reference to the drawings, in which.

DETAILED DESCRIPTION OF THE PREFERRED EMBODIMENTS

Figure 1:
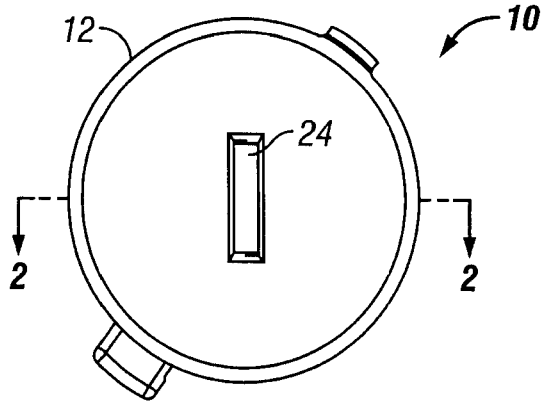
FIG. 1 is an end view of a sidebar lock provided by the invention.
Figure 2:
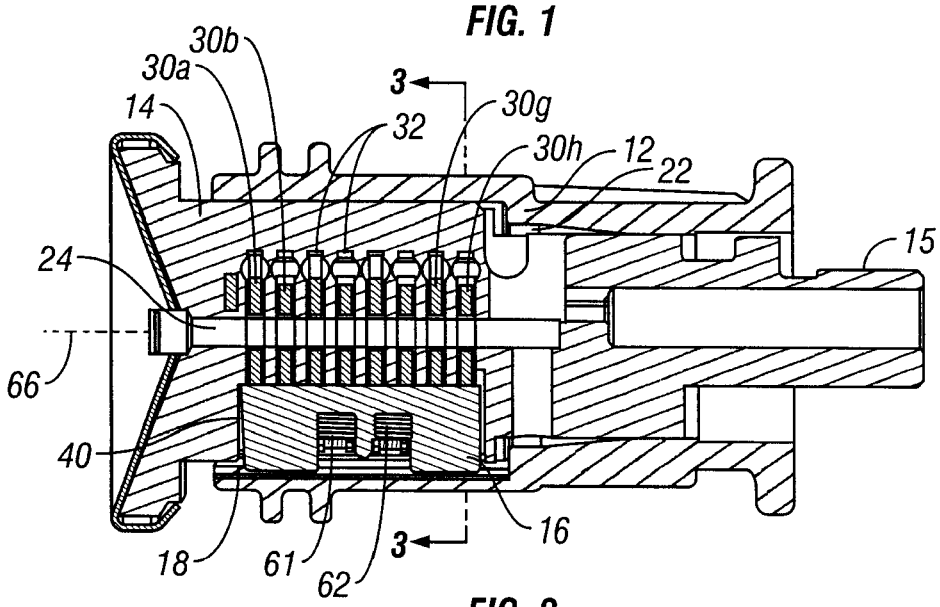
FIG. 2 is a transverse section view taken along the line 2—2 of FIG. 1 showing the sidebar extended for a key out condition.
Figure 3:
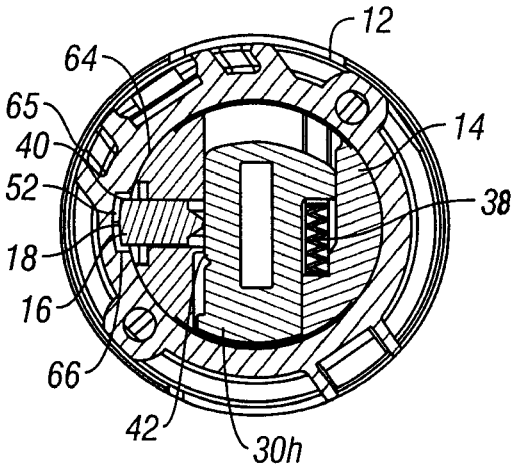
FIG. 3 is a vertical section view taken along the line 3—3 of FIG. 2.

Referring to FIGS. 1–3 of the drawings, there is shown a sidebar lock 10 provided by the invention. The sidebar lock 10 includes a sleeve 12, a lock barrel 14, and a sidebar 16. The sleeve 12 is a tubular, generally cylindrical member having a sidebar groove 18 formed in the sidewall of the sleeve 12.

One end 15 of the lock barrel 14 is adapted to be coupled to an output mechanism which is actuated when the lock barrel 14 is rotated. The output mechanism can be, but is not limited to, an ignition switch on an automobile, a latch mechanism for an automobile door, deck, hatch, lift gate or tail gate, the bail on a padlock, levers on panel locks, residential and commercial door latches, etc. For example, the lock barrel can have a lever or drive shaft attached thereto. The lever can be linked to the latch by a rod or cable arrangement. The drive shaft can be coupled with a latch or with a cable drive to the latch.

Figure 4:
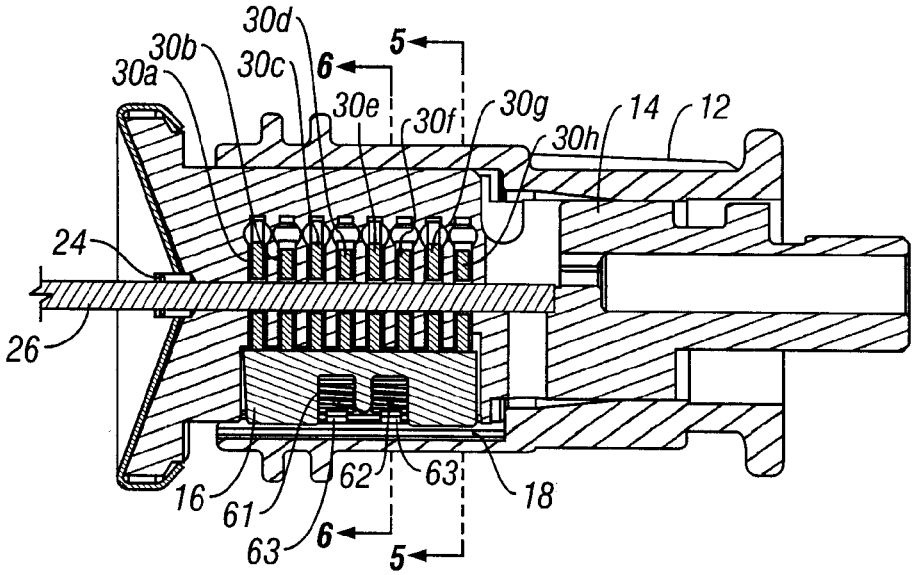
FIG. 4 is a transverse section view similar to that of FIG. 2 and with a properly coded key inserted into the lock barrel and the sidebar retracted into the lock barrel.
Figure 5:
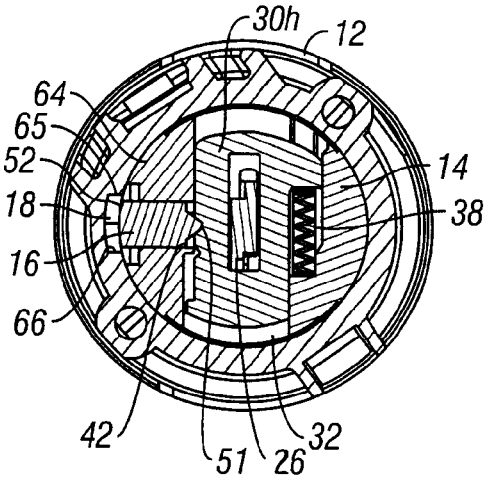
FIG. 5 is a vertical section view taken along the line 5—5 of FIG. 4.
Figure 6:
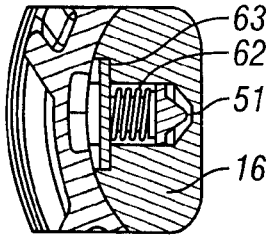
FIG. 6 is a vertical section view taken along the line 6—6 of FIG. 4.

The lock barrel 14 is a solid, generally cylindrical member which is rotatably received in a cavity 22 of the sleeve. The lock barrel 14 includes a key slot 24 for receiving a mating or "correct" key 26, as shown in FIGS. 4–6. The mating key 26 includes notched edges for engaging a plurality of tumblers 30*a*–30*h*, which, in one embodiment, are plate tumblers. The tumblers 30*a*–30*h* are located in tumbler wards 32 within the lock barrel 14. The tumblers 30*a*–30*h* are biased radially outward by tumbler springs 38, and movable inwardly, against the force of the tumbler springs 38 by the mating key in the known manner, when the mating key is inserted into the key slot 24.

The lock barrel 14 includes a sidebar slot 40 for receiving the sidebar 16. The tumbler wards 32 are communicated with the sidebar slot 40, allowing the tumblers 30*a*–30*h* to engage and move the sidebar 16 in the known manner. For a key out condition (FIGS. 2–3), the tumblers 30*a*–30*h* cause the sidebar 16 to extend into the sidebar groove 18 in the sleeve 12 to prevent rotation of the lock barrel. Each tumbler 30*a*–30*h* includes a notch 42.

Referring also to FIGS. 10–13, in one embodiment, the sidebar 16 is a generally rectangular in shape and includes a body portion 46. The body portion 46 includes opposing surfaces 47 and 48 and ends 49 and 50. The body portion 46 further includes an inner or tumbler engaging edge 51. The body portion includes an outer or sidebar groove engaging edge 52. The sidebar 16 includes a longitudinal gap 54, at or near the middle of the outer edge 52, forming an interruption in the outer edge 52. In one embodiment, the gap 54 is generally rectangular in shape and includes a projection 56 dividing the gap 54 into two compartments 58 and 60. The sidebar 16 is biased into the lock barrel 14 by a suitable resilient biasing mechanism which in one preferred embodiment can include one or more resilient bias elements which can be coil type compression springs, leaf springs, or any other suitable type of resilient bias element. For example, in one embodiment, illustrated in FIGS. 1–13, the compartments 58 and 60 are of sufficient size to locate and align a pair of bias springs 61 and 62 (FIGS. 2 and 4). The bias springs 61 and 62 bias the sidebar 16 into the lock barrel 14. With the bias springs 61 and 62 located within the gap 54, the bias springs 61 and 62 act near the longitudinal midpoint of the sidebar.

When the sidebar 16 is mounted in the lock barrel 14, the inner edge 51 is located adjacent to the tumblers 30*a*–30*h*. The outer edge 52 is located adjacent to the sidebar groove 18. The springs 61 and 62 are interposed between the base 55 of the gap 54 of the sidebar and the inner surface of the lock barrel 14. The springs 61 and 62 can be retained in the compartments 58 and 60 in the manner known in the art. For example, each of the springs 61 and 62 can be held in place by spring clips 63 (FIGS. 4 and 6) which overlie compartments 58 and 60 (FIG. 10) and have their ends secured to the lock barrel.

The sidebar 16 is movable radially between extended and retracted positions. When the sidebar 16 is in the extended position, a portion of the sidebar 16, including the outer edge 52 is located in the sidebar groove 18 in the sleeve 12 and the sides 47 and 48 cooperate with sides 65 and 66 of the sidebar groove 18 in the known manner to prevent the lock barrel 14 from rotating relative to the sleeve 12. In the retracted position, the sidebar 16 is retracted into the interior of the lock barrel 14, allowing the lock barrel 14 to rotate relative to the sleeve 12.

Because the bias springs 61 and 62 are located within the gap 54 at the center of the outer edge 52 of the sidebar 16, the longitudinal ends 49 and 50 of the sidebar can be of full height. That is, the width W of the longitudinal ends 49 and 50 of the sidebar 16 is limited only by draft, chamfers and corner radii, for example. Thus, in contrast to prior art sidebars, such as sidebar 126 shown in FIG. 30, for example, the sidebar 16 does not have reduced height portions, i.e., reduced width, located at opposite ends 49 and 50 of the sidebar 16. This significantly increases the sidebar engagement with the sleeve, as compared with the prior art, when an incorrect key, such as a cousin key, is present in the key slot because when the sidebar is inclined with respect to the axis of the lock barrel, the longitudinal ends of the sidebar body portion protrude deepest into the groove of the sleeve.

Figure 7:
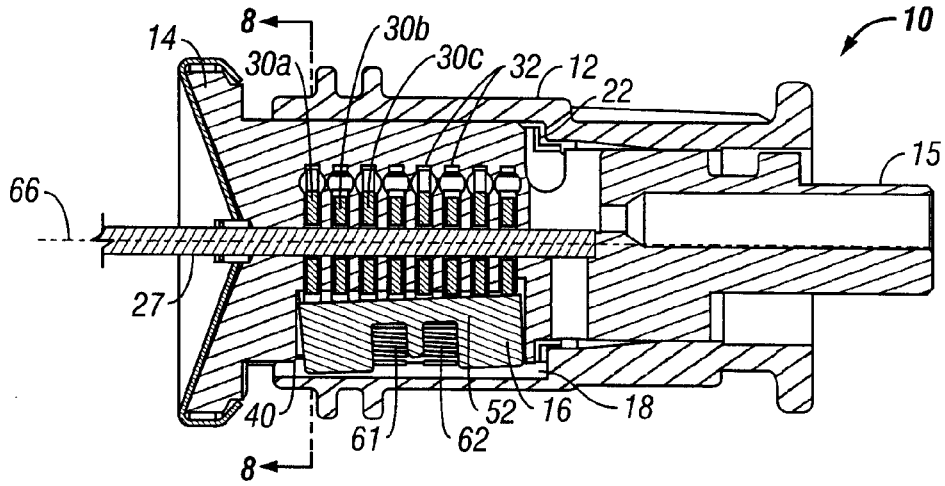
FIG. 7 is a transverse section view similar to FIG. 2 and with a cousin key inserted into the lock barrel and with the sidebar partially retracted into the lock barrel.
Figure 8:
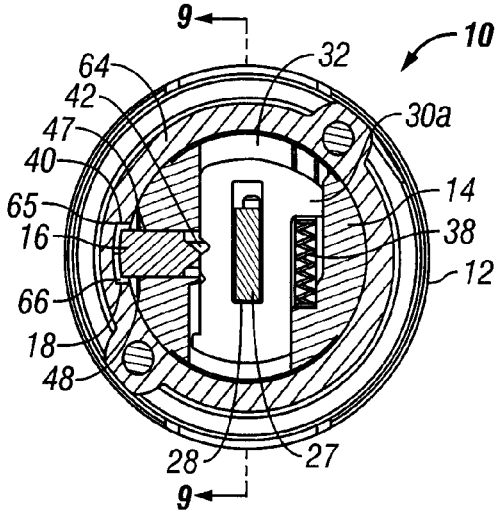
FIG. 8 is a vertical section view taken along the line 8—8 of FIG. 7.
Figure 9:
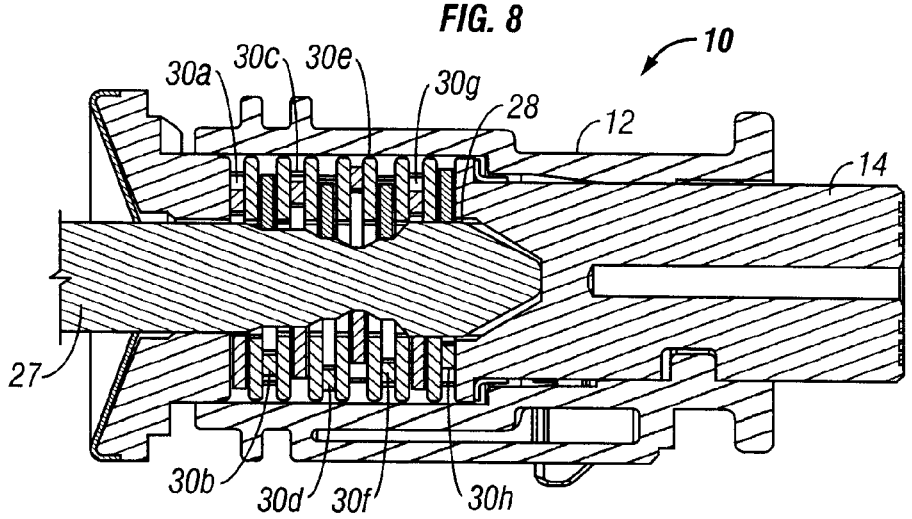
FIG. 9 is a vertical section view taken along the line 9—9 of FIG. 8.
Figure 10:
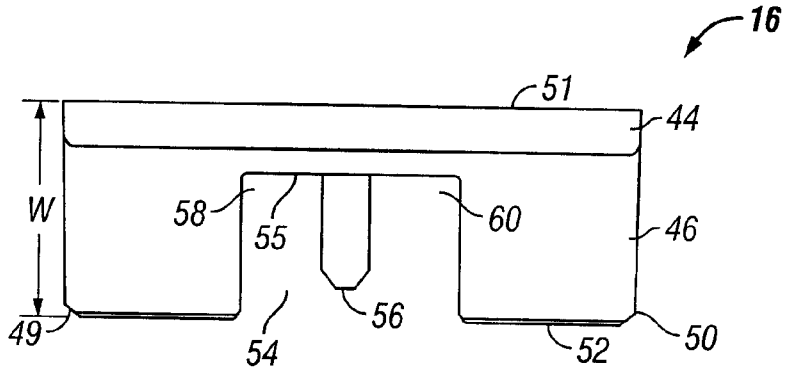
FIG. 10 is an elevation view of a sidebar of the sidebar lock of FIG. 1.
Figure 11:
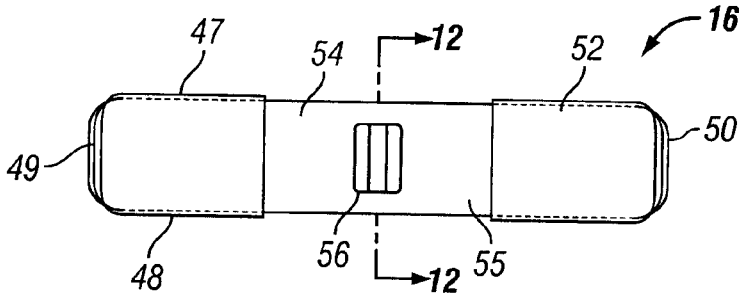
FIG. 11 is a bottom view of the sidebar of FIG. 10.
Figure 12:
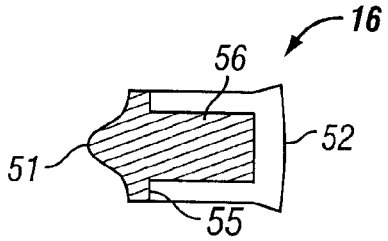
FIG. 12 is a section view taken along the line 12—12 of FIG. 11.
Figure 13:
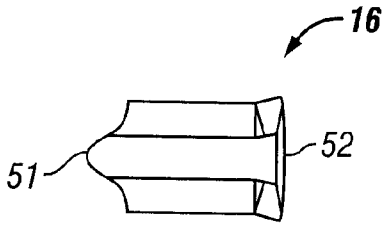
FIG. 13 is an end view of the sidebar of FIG. 10.
Figure 28:
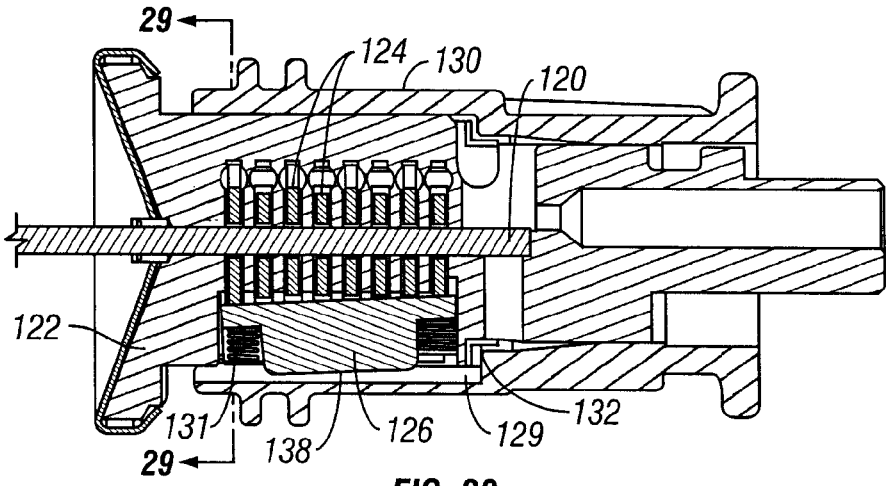
FIG. 28 (Prior Art)
FIG. 28, which is labeled "Prior Art",is a section view of a conventional sidebar lock, with a cousin key inserted into the lock barrel and with the sidebar partially retracted into the lock barrel.
Figure 29:
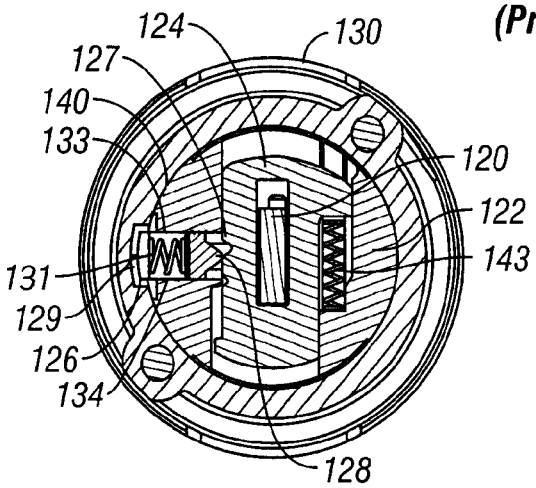
FIG. 29 (Prior Art)
FIG. 29, which is labeled "Prior Art",is a vertical section view taken along the line 29—29 of FIG. 28.

Referring to FIGS. 7–9, by way of illustration, the sidebar lock 10 has a key 27 inserted into the lock barrel of the sidebar lock 10. The key 27 is assumed to be a close cousin key of the mating key 26 (FIG. 4) for the sidebar lock 10. A close cousin key has all the key notch depths correct (i.e., the same as for the mating key) except for one, and the coding is off by only one step for the incorrect key notch depth. Thus, only one tumbler 30*a* is supporting the sidebar in the extended position. When only one tumbler is supporting the sidebar in the extended position, the sidebar will nearly always extend at an angle with respect to the axis of the lock barrel. The worst scenario occurs when the incorrectly coded portion of the key is at either the first tumbler 30*a* (as shown in FIG. 7 and 28) or the last tumbler 30*h*. For either condition, the sidebar is at the shallowest angle with respect to the axis of the lock barrel and the mechanical advantage of the inclined plane is the greatest. Another cousin key situation is when all key notch depths are correct except at the first two or three tumblers or the last two or three tumblers. Again, the sidebar will form an inclined plane. In either of these cases, the greater the number of tumblers supporting the sidebar in the extended position, the greater the resistance to forced rotation of the lock barrel. However, whenever a continuous inclined plane is formed across the shear line between the lock barrel and the sleeve, the mechanism to forcibly drive the sidebar into the barrel is present.

For a key out condition, as illustrated in FIGS. 2–3, the sidebar 16 is projected radially outward by the tumblers 30*a*–30*h*, parallel to the axis 66 of the lock barrel, into the sidebar groove 18 in the sleeve 12. For such condition, the edge 52 of the sidebar is located beyond the shear line 64 between the sleeve 12 and the lock barrel 14, in interference relation with the sides 65 and 66 of the sidebar groove 18, preventing the lock barrel 14 from rotating relative to the stationary sleeve 12.

When the correctly coded or mated key 26 is inserted into the key slot 24, as illustrated in FIGS. 4–6, the notches 42 on all of the tumblers 30*a*–30*h* are aligned with the inner edge 51 of the sidebar 16. As a result, the sidebar 16 is biased away from the sleeve 12 by the sidebar bias springs 61 and 62 and into the interior of the lock barrel 14 by the action of the sidebar bias springs 61 and 62. When the sidebar is retracted, the lock barrel 14 is permitted to rotate within the stationary sleeve 12. When a key with an incorrect code is inserted into locking barrel 14, the sidebar 16 is prevented from being retracted into the locking barrel 14 by the tumblers 30*a*–30*h* in the locations where the key code does not match.

Figure 14:
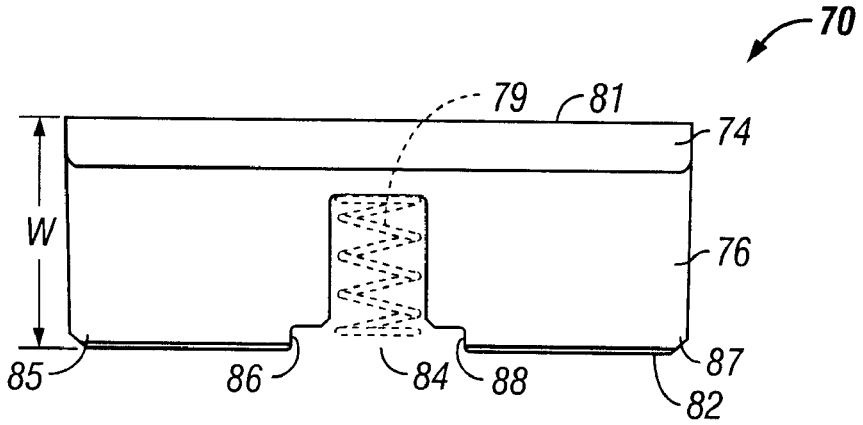
FIG. 14 is an elevation view of a further embodiment of a sidebar for the sidebar lock of FIG. 1.
Figure 15:
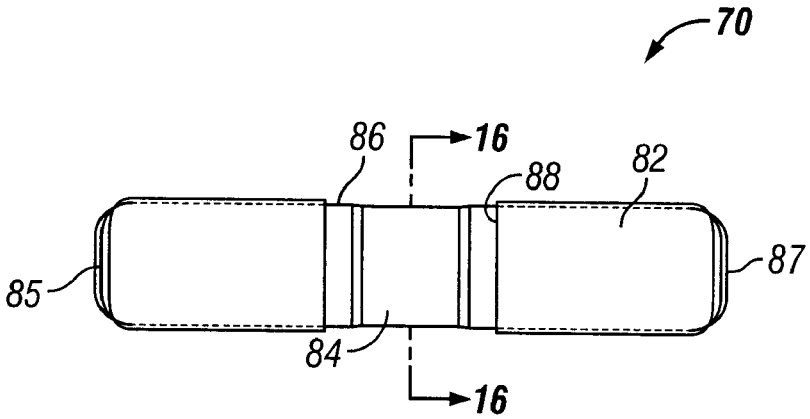
FIG. 15 is a bottom view of the sidebar of FIG. 14.
Figure 16:
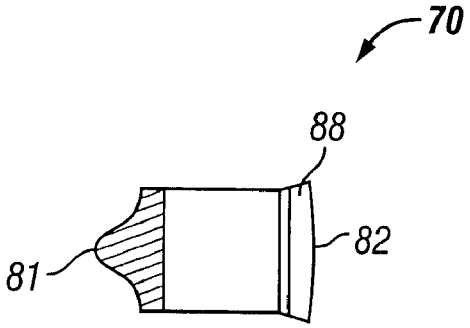
FIG. 16 is a section view taken along the line 16—16 of FIG. 15.
Figure 17:
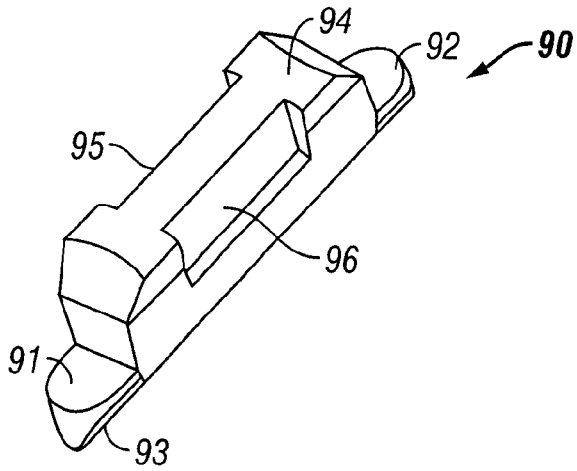
FIG. 17 is an isometric view of a further embodiment of a sidebar for the sidebar lock of FIG. 1.
Figure 18:
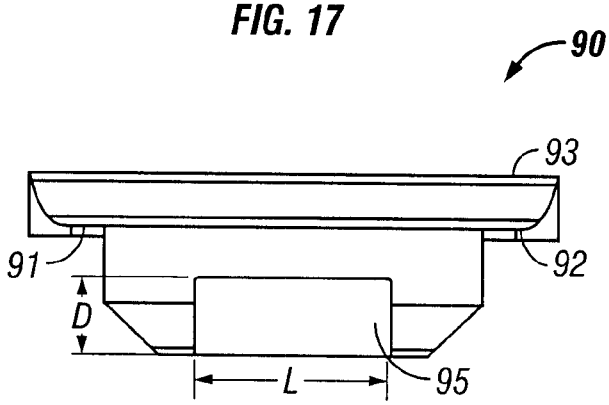
FIG. 18 is an elevation view of the sidebar of FIG. 17.
Figure 19:
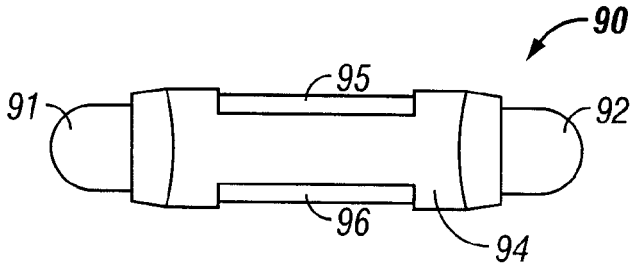
FIG. 19 is a bottom view of the sidebar of FIG. 18.
Figure 20:
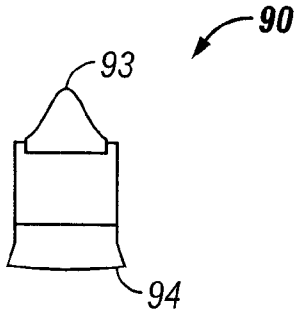
FIG. 20 is an end view of the sidebar of FIG. 18.

When the cousin key 27 is inserted into the locking barrel as illustrated in FIGS. 7–9, the notches of all of the tumblers, except the first tumbler 30*a*, are aligned with the outer edge of the sidebar. This allows the sidebar 16 to be retracted partially from the sidebar groove 18 and into the lock barrel 14 at an angle with respect to the axis 66 of the lock barrel 14. As shown in FIG. 7, for this condition, the outer edge 52 of the sidebar extends at an angle relative to the axis 66 of the lock barrel, and the surface of edge 52 of the sidebar 16 forms an inclined plane, which bridges the shear line 64 defined by the mating surfaces between the sleeve 12 and the lock barrel 14. However, because of the discontinuity provided by the longitudinal gap 54 in the outer edge 52 of the sidebar 16, the surface of the outer edge 52 of the sidebar is interrupted. This interruption prevents relative sliding movement between the outer edge 52 of the sidebar and the edges of the sleeve located adjacent to the sidebar groove 18, once the gap 54 engages one of the edges of the sidebar groove. Therefore, although the sidebar may be forced partially back into the lock barrel, the sidebar 16 is prevented from receding fully into the lock barrel 14 if an attempt is made to forcibly rotate the locking barrel 14. Therefore, the lock barrel 14 is prevented from being rotated using a cousin key, such as key 27. Because the gap 54 extends through the edge from one side to the other, the gap 54 is effective for rotation of the lock barrel in either direction FIGS. 14–16 illustrate a further embodiment of a sidebar 70 for the sidebar lock of FIG. 1. The sidebar 70 includes a base 74 with an inner or tumbler engaging edge 81 and a body portion 76 with an outer or sidebar groove engaging edge 82. The longitudinal ends 85 and 87 of the sidebar 70 can be of full height in the manner of ends of the sidebar 16. Thus, the width W of the longitudinal ends 85 and 87 of the sidebar 70 is limited only by draft, chamfers and corner radii, for example. The sidebar 70 differs from sidebar 16 in that the gap 84 in the outer edge 82 of the sidebar 70 defines a single bias spring receiving compartment. The sidebar 70 uses a single bias spring, indicated by the dashed line 79 in FIG. 14. The gap 84 is of sufficient size to locate and align the bias spring 79. The longitudinal gap 84 preferably is located at or near the middle of the outer edge 82 and locates and aligns the bias spring 79 which biases the sidebar 70 into the lock barrel 14. The spring 79 can be retained in the compartment by a spring clip (not shown), in the manner described above for springs 61 and 62 for sidebar 16. However, the sidebar 70 can be biased into the lock barrel 14 by any suitable resilient biasing mechanism which can be a single coil type compression spring, a leaf spring, or any other suitable type of resilient bias element.

The longitudinal gap 84 in the outer edge is smaller than the gap 54 in the sidebar 16. However, the outer edge 82 includes recessed portions 86 and 88 on both sides of the gap 84, providing an interruption in the outer edge 82 at each side thereof. The interruptions extend approximately the same length as the gap 54 in the outer edge 52 of sidebar 16 and that the recessed portions 86 and 88 in the outer edge 82 of sidebar 70 function similar to the interruption in the outer edge of sidebar 16 defined by gap 54. The sidebar 70 operates substantially in the same manner as the sidebar 16 as described above to prevent the lock barrel from being rotated by a cousin key.

Figure 33:
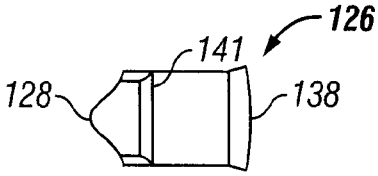
FIG. 33 (Prior Art)

FIGS. 17–20 illustrate another sidebar 90 provided by the present invention. The sidebar 90 can be similar to a conventional sidebar, such as the sidebar 126 shown in FIGS. 30 and 33, for example, and have bias springs located at opposite ends 91 and 92 of the sidebar in the manner of sidebar 126. The sidebar 90 includes an inner, tumbler engaging edge 93 and an outer, sidebar engaging edge 94. However, sidebar 90 has relieved regions 95 and 96 extending along a portion of the outer edge 94, on each side of the sidebar 90 at the axial midpoint. In one embodiment, in which the length of the sidebar 90 is about 18.89 millimeters, the length "L" of each of the relieved regions 95 and 96 can be about 7 millimeters, and the depth "D" of each of the relieved regions 95 and 96 can be about 2.5 millimeters. The thickness of the relieved regions 95 and 96 can be about 0.88 millimeters.

The relieved regions 95 and 96 on the outer edge 94 of the sidebar 90 accomplish the same function as the sidebars 16 and 70, which are illustrated in FIGS. 10–16, for example, by interrupting the contact between the angled surface of the sidebar 16 and the mating surfaces of the sleeve 12 and the lock barrel 14 at the shear line 64 (FIG. 8) between the lock barrel 14 and the sleeve 12. The interruptions in the outer edge 94 reduce the area of engagement between the edge of the sidebar and the sleeve 12, and therefore increase the ability of a sidebar lock incorporating the sidebar 90 to resist forced rotation of the lock barrel 14. Thus, in this embodiment, the interruption is provided by indenting or recessing the sides of the sidebar at the longitudinal midpoint of the sidebar. One of the recessed portions is effective for rotation of the lock barrel in one direction and the other recessed portion is effective for rotation of the lock barrel in the opposite direction.

Figure 21:
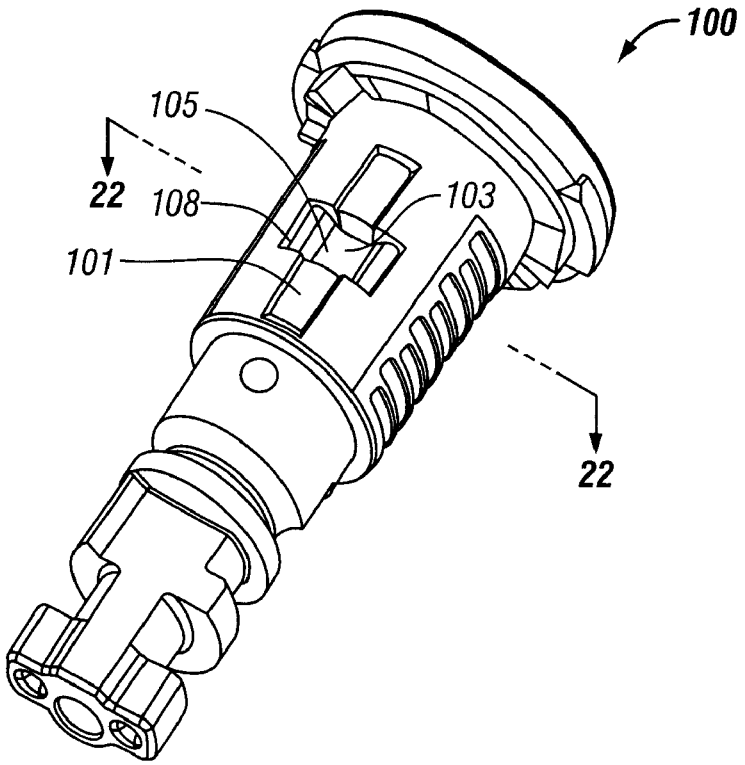
FIG. 21 is an isometric view of a lock barrel with a sidebar bias arrangement in accordance with a further embodiment of the invention.
Figure 22:
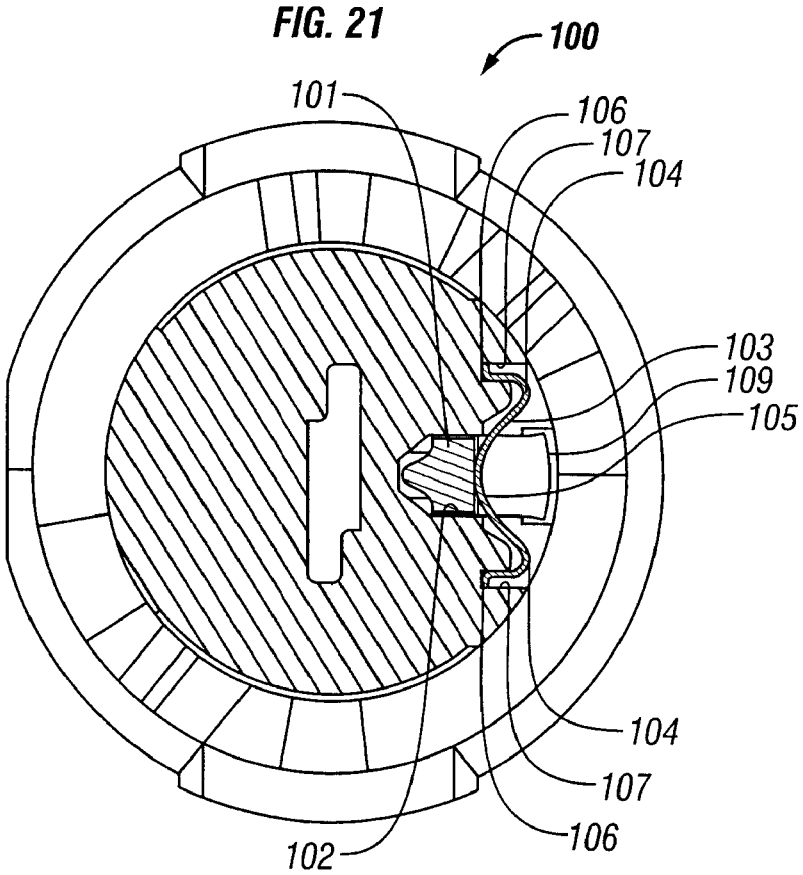
FIG. 22 is a section view taken along the line 22—22 of FIG. 21.
Figure 23:
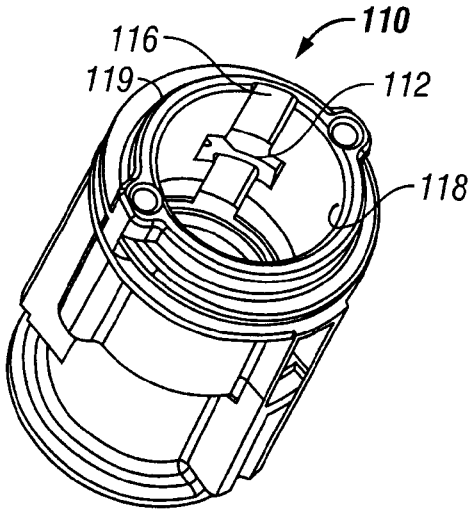
FIG. 23 is an isometric view of a case for a sidebar lock in accordance further embodiment of the invention, wherein the case includes an interrupted surface which defines the area of engagement for the sidebar.
Figure 24:
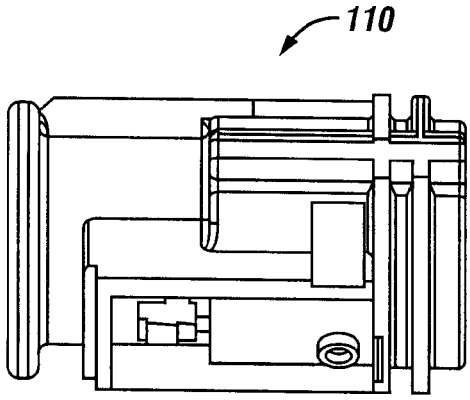
FIG. 24 is a side elevation view of the case of FIG. 23.
Figure 25:
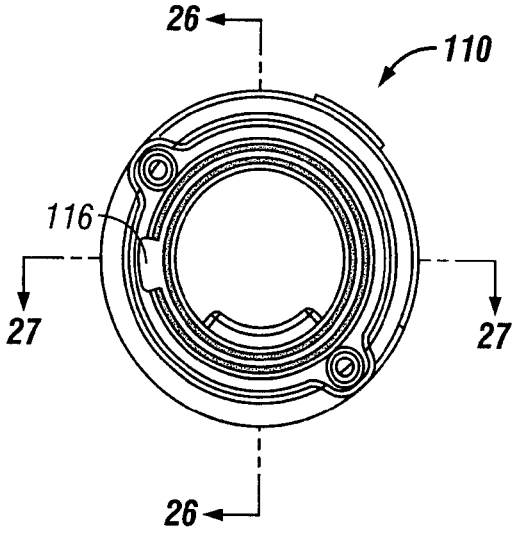
FIG. 25 is an end view of the case of FIG. 23.
Figure 26:
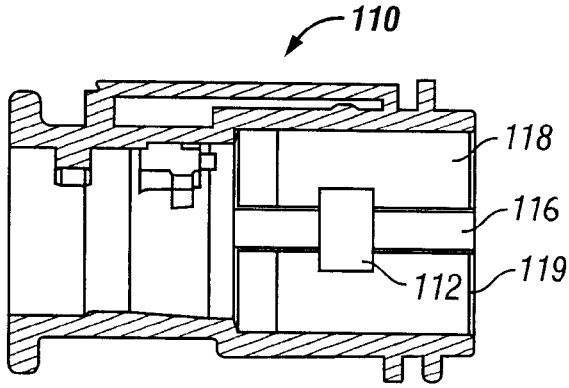
FIG. 26 is a vertical section view taken along the line 26—26 of FIG. 25.
Figure 27:
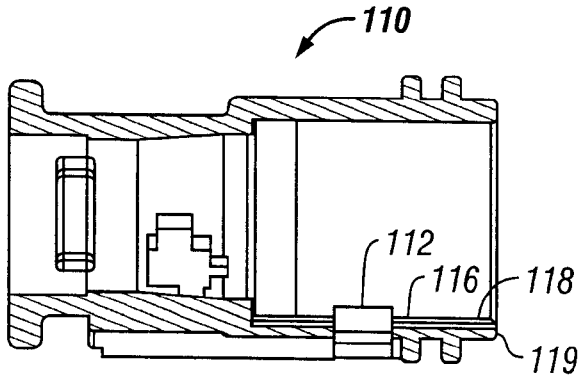
FIG. 27 is a transverse section view taken along the line 27—27 of FIG. 25.

Referring to FIGS. 21 and 22, is an isometric view of a further embodiment of a lock barrel 100 which can be used in the sidebar lock 10 described above with reference to FIGS. 1–9. The lock barrel 100 includes a sidebar bias mechanism which includes one or more leaf springs 103 for biasing a sidebar 101 into a slot 102 in the lock barrel. The leaf spring 103 is bent defining shoulders 104 on either side of an inwardly directed center portion 105 which engages the sidebar. The leaf spring has ends 106 received in notches 107 formed in a widened portion 108 of the groove of the lock barrel.

Briefly, assuming that the lock barrel 100, including sidebar 101 and leaf spring 103, is mounted within a sleeve, such as sleeve 12, for a key out condition, such as that illustrated for the sidebar lock 10 in FIGS. 2–3, the sidebar 101 is projected radially outward by tumblers, such as tumblers 30*a*–30*h*, against the force of the leaf spring 103, parallel to the axis of the lock barrel, into the sidebar groove of the sleeve in which the lock barrel 100 is contained. For such condition, the outer edge 109 of the sidebar 101 is located beyond the shear line between the sleeve 14 and the lock barrel 100, in interference relation with the sides of the sidebar groove 18, preventing the lock barrel 100 from rotating relative to the sleeve.

When the correctly coded or mated key is inserted into the lock barrel 100, the notches on all of the tumblers are aligned with the inner edge of the sidebar 101 in the manner described above with reference to FIGS. 4–6. As a result, the sidebar 101 is biased away from the sleeve by the leaf spring 103 and into the interior of the lock barrel 100 by the action of the leaf spring 103. When the sidebar is retracted, the lock barrel 100 is permitted to rotate within the sleeve in which the lock barrel 100 is contained.

Referring to FIGS. 23–27, there is illustrated sleeve 110 for a sidebar lock in accordance with a further embodiment of the invention. The sleeve 110 is generally similar to sleeve 12 shown in FIGS. 1–6, and includes a sidebar groove 116 extending along a portion of the inner surface 118 of the sleeve 110.

Figure 30:
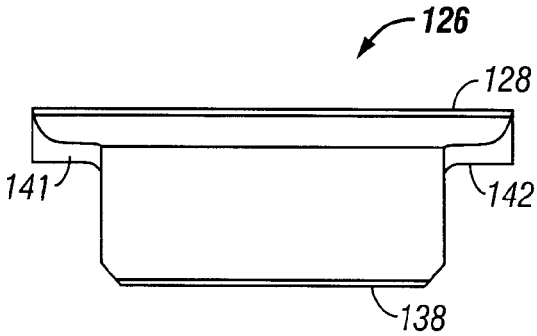
FIG. 30 (Prior Art)
FIG. 30, which is labeled "Prior Art",is an elevation view of the sidebar of the sidebar lock of FIG. 28.
Figure 31:
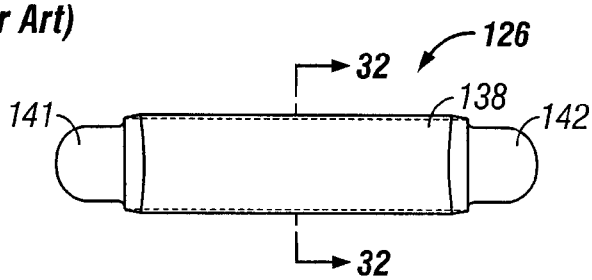
FIG. 31 (Prior Art)
FIG. 31, which is labeled "Prior Art",is a bottom view of the sidebar of FIG. 30.
Figure 32:
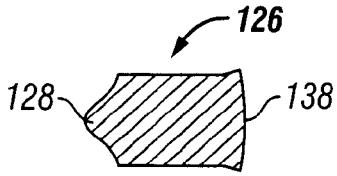
FIG. 32 (Prior Art)
FIG. 32, which is labeled "Prior Art",is a section view taken along the line 32—32 of FIG. 31; and, FIG. 33, which is labeled "Prior Art",is an end view of the sidebar of FIG. 30.

The sleeve 110 can be used in a sidebar lock having a conventional sidebar such as the sidebar 126 shown in FIGS. 28 and 30, for example, and have bias springs located at opposite ends of the sidebar in the manner of sidebar 126. Moreover, the sleeve 110 can be used in a sidebar lock incorporating the sidebar 16, the sidebar 70, the sidebar 90, or the sidebar 100.

In this embodiment, the interruption is defined by the sleeve 110, such as by widening the sidebar groove 116 in the sleeve 110, preferably near the axial midpoint of the outer edge of the sidebar. In one embodiment, the interruption in the sidebar groove 116 is provided by an aperture 112 through the sidewall 119 of the sleeve 110. In one embodiment, the aperture 112 is generally rectangular in shape. However, the aperture 112 can be of other geometrical shapes. Moreover, although in one preferred embodiment, the aperture 112 extends through the sidewall 119 of the sleeve 110, the interruption can be provided by a recess formed in the surface 118 of the sleeve, such recess being of a depth greater than the depth of the sidebar groove 116. The aperture 112 is located to interrupt the sidebar groove 116 near the axial midpoint of the sidebar groove 116. In one embodiment wherein the length of the sidebar groove 116 is approximately 21 millimeters, the axial length of the aperture 112 is approximately 10 millimeters and the circumferential length of the aperture 112 is approximately 15 millimeters.

The sleeve 110 cooperates with the sidebar, such as sidebar 126, of the lock in a manner similar to the cooperation of the sidebar 16 with sleeve 12 as described above to prevent the lock barrel from being rotated by a cousin key. The interruption in the sidebar groove 116 provided by recess 112 prevents relative sliding movement between the outer edge of the sidebar and the edges of the sidebar groove 116, once the outer edge of the sidebar engages one of the edges of the sleeve. Therefore, although the sidebar may be forced partially back into the lock barrel, the sidebar is prevented from receding fully into the lock barrel of the sidebar lock if an attempt is made to forcibly rotate the lock barrel. Therefore, the lock barrel is prevented from being rotated using a cousin key, such as key 27 (FIGS. 7–9).

Thus, the present invention prevents the use of a cousin key to cause the withdrawal of a sidebar into a lock barrel to the extent necessary to allow the lock barrel to be rotated. The prevention of rotation of a lock barrel is afforded by providing an interruption in a surface of the sidebar, or a surface of the sleeve, at or near the sidebar longitudinal mid-point of the sidebar. Consequently, when a cousin key is inserted into the lock barrel, the cousin key can cause the sidebar surface to extend at an angle with respect to the axis of the lock barrel. However, the interruption prevents the surface of the sidebar from sliding along the surface of the sleeve adjacent to the edges of the sidebar groove, preventing the sidebar from being driven into the lock barrel when the lock barrel is forcibly rotated.

In one embodiment, the interruption is provided by a gap at or near the longitudinal midpoint of the sidebar of sufficient size as to accommodate the sidebar bias spring or springs. In another embodiment, the interruption is provided by indenting or relieving the sides of the sidebar near the longitudinal midpoint. In a further embodiment, the interruption is provided by widening the sidebar groove in the sleeve in a region corresponding to the longitudinal midpoint of the sidebar.

According to this invention, the sidebar biasing springs or spring, or other resilient biasing mechanism, are located in the center gap of the sidebar rather than at the longitudinal ends of the sidebar as in conventional sidebar locks. This permits the sidebar ends to extend deeper into the sidebar groove, thus increasing the bearing area to resist forced rotation when the sidebar is oriented at an inclined angle. Consequently, when an attempt is made to use a key having a code that is very similar to the correct code, the use of such key might permit some rotation of the lock barrel, but the interruption prevents the forcing of the sidebar from the sleeve groove sufficiently so as to defeat the locking function.

Although exemplary embodiments of the present invention have been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A sidebar lock comprising:

a sleeve including a sidebar groove having an edge and extending longitudinally along a surface of said sleeve;

a lock barrel supported within said sleeve for rotation relative to said sleeve, said lock barrel being adapted for connection to an output mechanism;

a sidebar having an edge, said sidebar being movable radially relative to said lock barrel between an extended position in which a portion of said sidebar, including said edge, extends into said sleeve sidebar groove and cooperates with said sleeve sidebar groove to prevent relative rotation between said lock barrel and said sleeve, and a retracted position in which said sidebar is retracted into said lock barrel, permitting relative rotation between said lock barrel and said sleeve, the sidebar pivotable to a partially retracted position in which part of the sidebar edge is located within the groove and part of the sidebar edge is located outside of the groove, the sidebar edge slideable in the partially retracted position of the sidebar along the edge of the sidebar groove; and a longitudinally extending interruption in at least one of said edge of said sidebar and said sidebar groove in said surface of said sleeve, the interruption located at the longitudinal midpoint of said at least one edge of said sidebar and said sidebar groove, the longitudinal length of said interruption being less than the longitudinal length of said sidebar edge, said interruption sufficiently long to limit relative sliding movement between said sidebar edge and the edge of said sidebar groove.

2. The sidebar lock according to claim 1, wherein said sidebar is generally rectangular in shape and includes at least one longitudinal indentation on at least one edge near the longitudinal mid-point of the sidebar edge, said indentation defining said interruption.

3. The sidebar lock according to claim 1, wherein said sidebar is generally rectangular in shape and includes at least one longitudinal gap in said edge near the longitudinal mid-point of said sidebar, said gap defining said interruption.

4. The sidebar lock according to claim 3, and further including a bias structure for resiliently biasing said sidebar into said lock barrel.

5. The sidebar lock according to claim 4, wherein said bias structure acts near the longitudinal mid-point of said sidebar.

6. A sidebar lock comprising:

a stationary sleeve including an axial groove having an edge;

a lock barrel supported within said stationary sleeve for rotation relative to the sleeve, the lock barrel including a key slot, the lock barrel being adapted for coupling to an output mechanism;

a sidebar having a tumbler edge and a groove edge, the sidebar being movable radially relative to said lock barrel between an extended position in which a portion of the sidebar, including said groove edge, extends into said sleeve axial groove and cooperates with said sleeve axial groove to prevent relative rotation between said lock barrel and said sleeve, and a retracted position in which said sidebar is retracted into said lock barrel and permits relative rotation between said lock barrel and said sleeve, said sidebar being shifted from said extended position to said retracted position upon the insertion of a key into said key slot, the sidebar pivotable to a partially retracted position in which part of the groove edge is located within the axial groove and part of the groove edge is located outside of the axial groove, the groove edge slideable in the partially retracted position of the sidebar along the edge of the axial groove; and said sidebar having a longitudinally extending interruption in a surface of said groove edge at the longitudinal midpoint of said sidebar, the length of said interruption being less than the longitudinal length of said groove edge, said interruption sufficiently long to limit relative sliding movement between said groove edge of said sidebar and the edge of said axial groove of said sleeve.

7. The sidebar lock according to claim 6, wherein said sidebar includes at least one longitudinal indentation on said groove edge near the longitudinal mid-point of said edge, said longitudinal indentation defining said interruption in said surface of said groove edge.

8. The sidebar lock according to claim 6, wherein said sidebar includes at least one longitudinal gap in said groove edge near the longitudinal mid-point of said sidebar, said gap defining said interruption in said surface of said groove edge.

9. The sidebar lock according to claim 8, wherein said sidebar is generally rectangular in shape, said sidebar having first and second longitudinal ends, said tumbler edge and said groove edge extending longitudinally between said first and second longitudinal ends, and wherein said longitudinal ends of the sidebar are of substantially full width.

10. The sidebar lock according to claim 8, and further including a bias structure for resiliently biasing the sidebar in to said lock barrel, and wherein said gap is of sufficient size to accommodate said bias structure.

11. The sidebar lock according to claim 10, wherein said bias structure acts near the longitudinal mid-point of said sidebar.

12. The sidebar lock according to claim 10, wherein said sidebar i s generally rectangular in shape, said longitudinal gap defining support for said bias structure.

13. The sidebar lock k according g to claim 10, wherein said bias structure comprises a resilient bias element.

14. A sidebar lock comprising:

a stationary sleeve including an axial groove having first and second ends and an edge;

a lock barrel supported within said stationary sleeve for rotation relative to the sleeve, the lock barrel being adapted for connection to an output mechanism; and a sidebar having a tumbler edge and a groove edge, the sidebar being movable radially relative to said lock barrel between an extended position in which a portion of the sidebar, including said groove edge, extends into said sleeve axial groove, and a retracted position in which said sidebar is retracted into said lock barrel, the sidebar pivotable to a partially retracted position in which a portion of the groove edge extends out of the axial groove, the groove edge slideable in the partially retracted position of the sidebar along the edge of the axial groove, wherein a portion of said sleeve axial groove is widened transversely between said first and second ends in the proximity of the longitudinal mid-point of said sidebar, said widened portion defining an interruption in the sleeve axial groove, the longitudinal length of the transversely widened portion of said sleeve axial groove being less than the longitudinal length of the sleeve axial groove, said interruption sufficiently long to limit relative sliding movement between said groove edge of the sidebar and edges of said axial groove.

15. A sidebar lock comprising:

a sleeve including an axial groove having an edge;

a lock barrel supported within said sleeve for rotation relative to the sleeve by a mating key, the lock barrel being adapted for connection to an output mechanism;

a sidebar having a tumbler edge and a groove edge, the sidebar being movable radially relative to said lock barrel between an extended position in which a portion of the sidebar, including said groove edge, extends into said sleeve axial groove, and a retracted position in which said sidebar is retracted into said lock barrel, the sidebar pivotable to a partially retracted position in which a first portion of the sidebar is extended from the axial groove and a second portion of the sidebar is retracted into the axial groove, the groove edge slideable in the partially retracted position of the sidebar along a length of the edge of the axial groove; and said sidebar having a longitudinally extending gap through said groove edge between opposite sides of said groove edge, the longitudinal length of said gap being less than the longitudinal length of said groove edge, defining a center gap discontinuity at the mid-point of the groove edge to prevent the groove edge of the sidebar from sliding along the edge of the axial groove once the gap engages the edge of the axial groove in the sleeve.

16. A sidebar for a sidebar lock, the lock including a lock barrel rotatable within a sleeve when a mated key is inserted into the lock barrel, the sidebar preventing rotation of the lock barrel relative to said sleeve in the absence of a mated key in said lock barrel, said sidebar comprising:

a sidebar body which is generally rectangular in shape, said sidebar body having first and second longitudinal ends, first and second oppositely facing sides extending longitudinally between said first and second longitudinal ends and received within the sleeve to prevent rotation of the lock barrel, a third side joining the first and second sides and extending between the first and second longitudinal ends wherein the first and third sides define a comer of the sidebar running longitudinally along the sidebar, and an indentation in the comer near the longitudinal midpoint of said sidebar body, wherein the longitudinal length of said indentation is less than the longitudinal length of said first and second sides.

* * * * *